US008448783B2

(12) United States Patent
Vecchi

(10) Patent No.: US 8,448,783 B2
(45) Date of Patent: May 28, 2013

(54) PACKET AND CORRESPONDING BLANK

(75) Inventor: Marco Vecchi, Medicina (IT)

(73) Assignee: Gima S.p.A., Zola Predosa (BO) (IT)

( * ) Notice: Subject to any disclaimer, the term of this patent is extended or adjusted under 35 U.S.C. 154(b) by 96 days.

(21) Appl. No.: 13/002,128

(22) PCT Filed: Jun. 30, 2009

(86) PCT No.: PCT/IB2009/052829

§ 371 (c)(1),
(2), (4) Date: Feb. 18, 2011

(87) PCT Pub. No.: WO2010/001334

PCT Pub. Date: Jan. 7, 2010

(65) Prior Publication Data

US 2011/0240494 A1 Oct. 6, 2011

(30) Foreign Application Priority Data

Jul. 4, 2008 (IT) ..... MO2008A0188

(51) Int. Cl.
*A24F 15/00* (2006.01)
*B65D 85/10* (2006.01)
*B65D 85/12* (2006.01)

(52) U.S. Cl.
USPC ..... 206/267; 206/273; 229/909

(58) Field of Classification Search
USPC ..... 206/273, 251, 262, 265, 271, 276, 206/242; 229/909, 122.21, 125.05, 220
See application file for complete search history.

(56) References Cited

U.S. PATENT DOCUMENTS

| | | | | |
|---|---|---|---|---|
| 4,823,059 | A | 4/1989 | Compeau et al. | |
| 5,183,523 | A * | 2/1993 | Rinehart et al. | 156/367 |
| 2005/0121340 | A1 * | 6/2005 | Spatafora | 206/259 |
| 2005/0224375 | A1 * | 10/2005 | Focke et al. | 206/259 |

FOREIGN PATENT DOCUMENTS

| | | | |
|---|---|---|---|
| EP | 0414532 | A1 | 2/1991 |
| EP | 0 545 723 | A1 | 6/1993 |
| WO | 03/002427 | A1 | 1/2003 |
| WO | 2005/014436 | A1 | 2/2005 |

OTHER PUBLICATIONS

Int'l Search Report issued on Oct. 21, 2009 in Int'l Application No. PCT/IB2009/052829.
Written Opinion issued on Oct. 21, 2009 in Int'l Application No. PCT/IB2009/052829.

* cited by examiner

*Primary Examiner* — Luan K Bui
*Assistant Examiner* — Rafael Ortiz
(74) *Attorney, Agent, or Firm* — Panitch Schwarze Belisario & Nadel LLP

(57) ABSTRACT

A packet for smoke articles has an external enclosure (2) including a containing body (3) and a closing body (4) that is rotatable around a hinge (35) obtained on an external wall of said packet (1). The packet (1) includes closing elements (50) associated with main wall means (22, 23, 24) of the internal enclosure (2) for closing a base portion (6) and a top portion (7) of the packet (1). The external enclosure (2) further includes a secondary base wall (31) and a secondary top wall (11) connected to the main wall means (22, 23, 24) and arranged for abutting on and supporting said closing elements (50).

9 Claims, 7 Drawing Sheets

Fig. 5
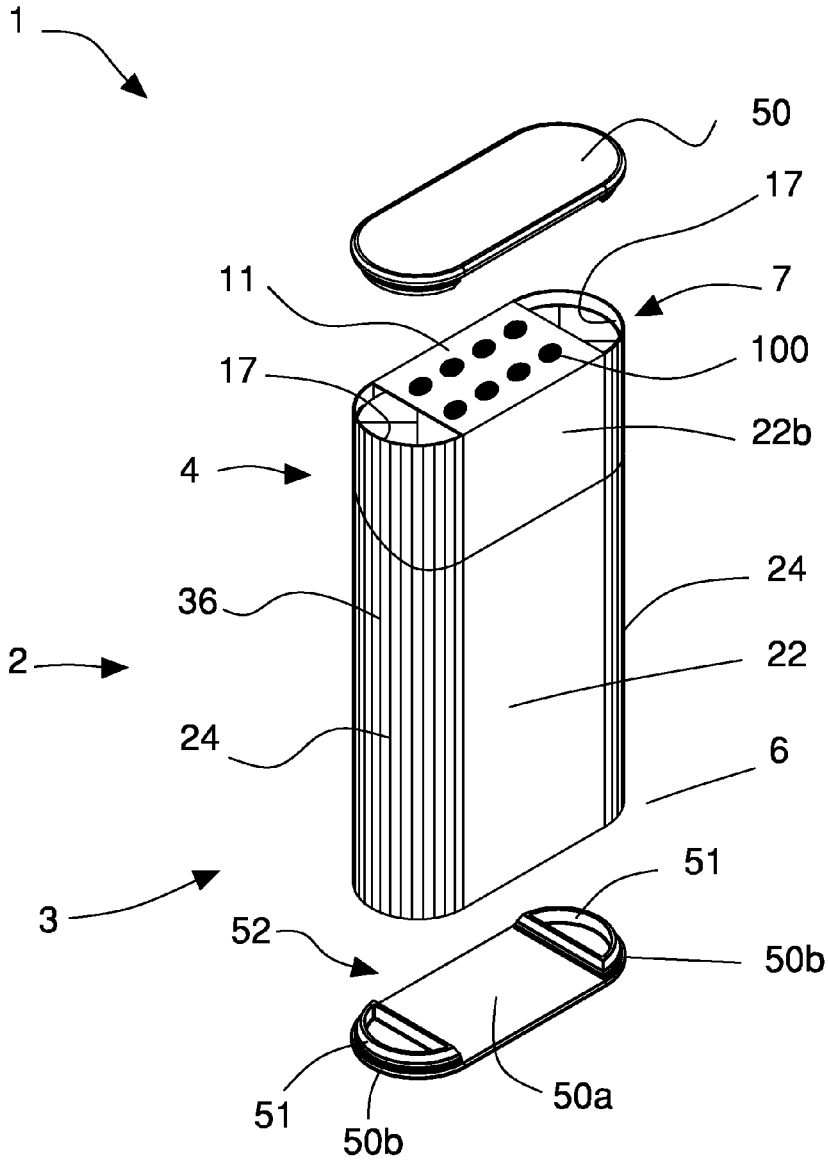
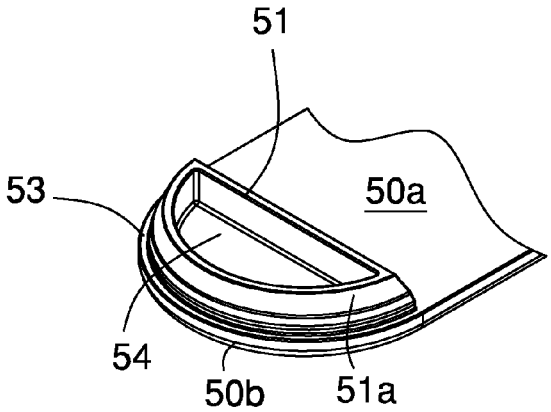
Fig. 10

PACKET AND CORRESPONDING BLANK

CROSS-REFERENCE TO RELATED APPLICATION

This application is a section 371 of International Application No. PCT/IB2009/052829, filed Jun. 30, 2009, which was published in the English language on Jan. 7, 2010 under International Publication No. WO 2010/001334 A1 and the disclosure of which is incorporated herein by reference.

The invention relates to packets for smoke articles, such as cigars or cigarettes, and in particular it relates to a stiff packet and a corresponding blank from which it is possible to make said packet.

Stiff packets for cigarettes with a hinged lid are known, so-called 'hinge-lid" packets, which are particularly appreciated by smokers for their great stiffness, which prevents damage to the cigarettes even when the packet is subjected to blows or kept in a pocket or a bag of a consumer.

These packets comprise a stiff external shell or enclosure inside which an internal enclosure consisting of a group of wrapped cigarettes is inserted, which are typically wrapped in a sheet of metal foil.

The external stiff enclosure, which is made by folding from a suitable blank made of sheet material, such as card, cardboard, paper or the like, comprises a containing body and a hinged lid. The latter is joined to the containing body by a folded line, that acts as a hinge, made on a wall of the packet.

Recently, a tendency to customise hinged-lid packets has emerged, in order to induce smokers to prefer a packet having a certain appearance that is more elegant or original than other packets with a more traditional appearance.

In order to customise the packets, it is possible to use writing, drawings or more in general promotional messages printed on the visible surfaces of the packet or vary the shape or the structure of the packet.

Traditional stiff packets, which are entirely formable by folding a single blank, in fact have a parallelpipedon shape, with flat walls, separated by right-angled corners or bevelled or rounded corners. The parallelpipedon shape gives the packet stability and robustness and ensures that the packet closes completely, preventing the product escaping to the exterior.

With normal packaging machines, which are used to produce traditional stiff packets, it is nevertheless not possible to make packets with curved walls or which have a rectangular, rounded, oval, elliptical or similar cross section. Such packets would in fact be instable, could not be completely closed at the base and at the top and would have an unacceptable aesthetic appearance.

Stiff packets are known in which the external enclosure is provided with curved walls or has an oval, elliptical or similar cross section.

EP 0414532 discloses a stiff packet with a hinged lid that is provided with an external enclosure in which a front flat wall and a rear flat wall, which are parallel to and opposite one another, are connected by curved side walls. The lid is hinged on a rear face of the body of the external enclosure. The latter is made of a tubular shape that suitably winds two layers of superimposed and glued sheet material obtained from respective blanks around a shaped shaft. The packet is then completed by gluing closing elements to base and top portions of the tubular external enclosure.

U.S. Pat. No. 4,823,059 shows a stiff packet with a hinged lid that has an oval cross section, i.e. comprising an external enclosure provided with curved walls. The external enclosure comprises a body formed by an internal sleeve inserted inside an external sleeve, on which the lid is hinged. A base portion of the body and a top portion of the lid of the packet are closed by respective caps or lids, glued on an internal surface of the external sleeve. The caps prevent the product from escaping and maintain the packet stable in the desired curved shape.

U.S. Pat. No. 5,183,523 shows a method and an apparatus for ultrasound welding of closing caps for containers for foodstuffs or tobacco comprising an oval cardboard pipe that is open at the ends. Adhesive material is applied to internal surfaces of said ends that enables the caps to be fixed stably.

The packets disclosed above are not processable on normal packaging machines but require the use of different machines or production lines. It is clear that for manufacturers, choosing to produce such packets entails purchasing new dedicated packaging machines, with very high costs to be incurred.

A further drawback of the aforesaid hinged-lid packets consists of the fact that they are made using two layers of superimposed and glued sheet material in order to obtain a suitably stiff and stable shape. Such packets are therefore more expensive to produce than traditional packets.

An object of the invention is to improve packets, in particular for smoke articles, such as cigarettes, and the blanks that are usable for making such packets.

Another object is to make a stiff packet having great aesthetic appeal comprising ample curved walls, that can easily be produced on traditional packaging machines with substantially conventional productive processes.

A further object is to obtain a packet having a stiff external enclosure comprising curved walls, that is robust and stable and ensures that the contents are contained correctly.

Still another object is to obtain a packet that is entirely formable by suitably folding a single blank.

In a first aspect of the invention a packet is provided, particularly a packet for smoke articles, comprising an outer enclosure including a containing body and a closing body, that is rotatable around a hinge obtained on an external wall of said packet, said packet including closing elements associated with main wall means of said external enclosure for closing a base portion and a top portion of said packet, characterised in that said external enclosure further comprises a secondary base wall and a secondary top wall connected to said main wall means and arranged for abutting on and supporting said closing elements.

The secondary base wall and the secondary top wall are opposite one another and transverse, in particular substantially orthogonal, to the main wall means, in a closed configuration of said packet. The main walls means comprise a front wall and a rear wall, that are opposite one another, and side walls interposed between and connecting said front wall and said rear wall.

The front wall and the rear wall are substantially flat and parallel, whilst the side walls are curved.

Owing to this aspect of the invention it is thus possible to make a packet provided with a stiff external enclosure comprising curved walls that can be processed in a normal packaging machine inasmuch as it is made by suitably folding a single blank. The external enclosure comprises, in fact, a containing body and a lid body hinged as in traditional packets.

The closing elements can be further easily fixed to the base portion and to the top portion of the packet, once folding of the external enclosure has terminated.

The side walls form with the secondary base wall and the secondary top wall respectively first openings and second openings arranged for receiving protrusions made on end portions of each closing element.

The protrusions form abutting edges arranged for engaging end edges of the side walls. At the same time, the protrusions make, with a central portion of the closing element, a seat that is suitable for receiving the base wall or the top wall. In this manner the closing elements constitute a support and a guide for the side walls of the containing body, so as to confer on the packet a stable shape and a robust structure.

In a second aspect of the invention, a blank for producing a packet is provided, in particular a packet for smoke articles, comprising a first portion, intended for forming a containing body of said packet and connected along an intended folded line to a second portion, intended for forming a closing body of said packet, said blank comprising:

- a first central panel intended for forming a rear wall of said packet;
- a first transverse panel and a second transverse panel arranged at opposite ends of said first central panel and intended for forming respectively a base wall and a top wall of said packet;
- a second central panel and a third central panel connected respectively to said first transverse panel and to said second transverse panel and intended for forming a front wall of said packet;
- side panels arranged on the sides of said central panels and intended for forming side walls of said packet;

said blank being characterised in the fact that said side panels and said transverse panels form on said blank respective recesses, at which said side panels and said transverse panels are devoid of foldable appendages.

The first transverse panel and the second transverse panel further have respective transverse dimensions that are less than a width of the formed packet.

The side panels are provided with a plurality of respective intended longitudinal folded lines so as to form curved side walls.

The blank provided for by the second aspect of the invention enables the packet to be produced easily according to the first aspect of the invention even on traditional machines, inasmuch as this blank has an external outline that is similar to that of traditional blanks. In particular the recesses and the width of the transverse panels enable the side panels, when they are folded, to form with the transverse panels openings in the external enclosure of the packet that are suitable for receiving the protrusions of the closing elements.

The invention can be better understood and implemented with reference to the attached drawings, which illustrate some embodiments by way of non-limiting example, in which:

FIG. 5 is a partially exploded perspective view of the packet in FIG. 1;

FIG. 10 is an enlarged detail of the closing element in FIG. 5;

Figure 1:
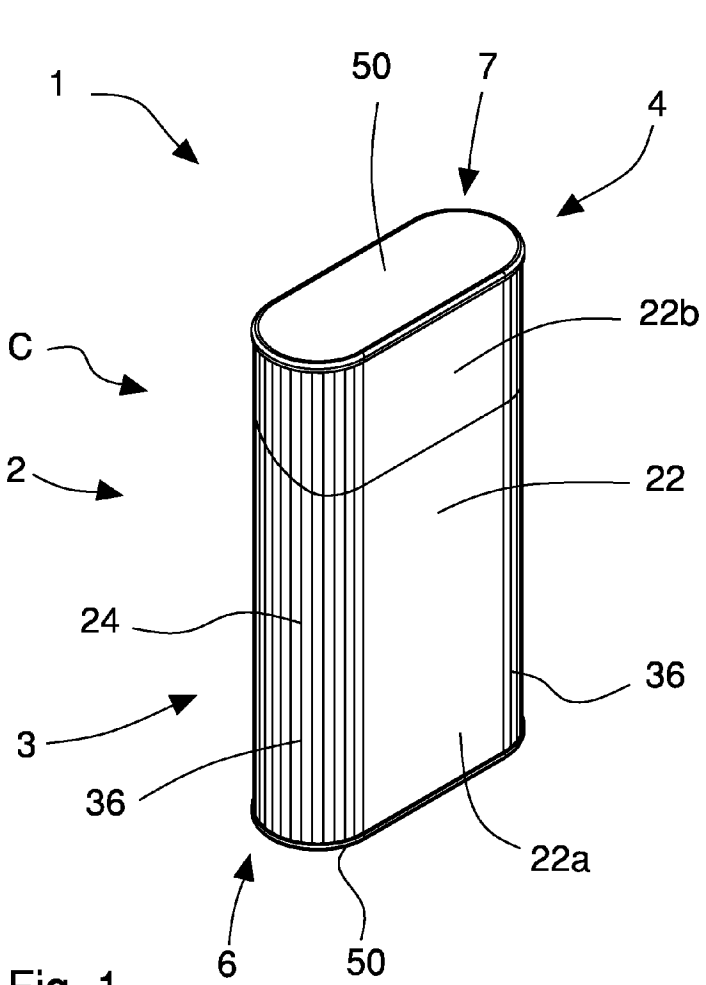
FIG. 1 is a front perspective view of a packet for smoke articles according to the invention, in a closed configuration.
Figure 2:
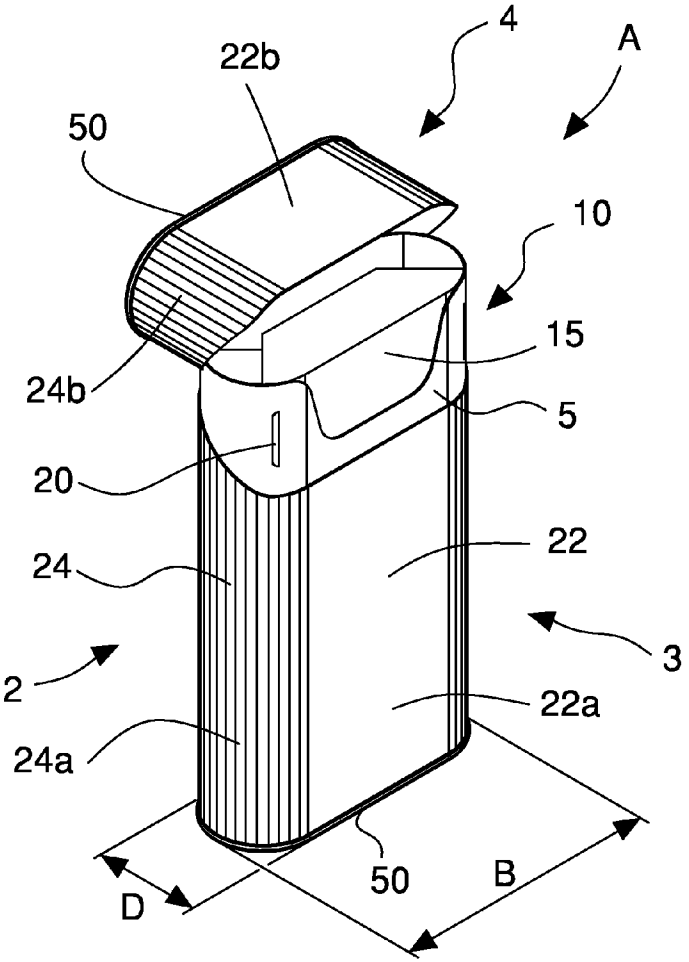
FIG. 2 is a front perspective view, of the packet in FIG. 1, in an open configuration.

With reference to FIGS. 1 to 5 there is illustrated a packet 1 for smoke articles, particularly cigarettes. The packet 1, of stiff type, comprises an external enclosure 2 provided with main wall means comprising a front wall 22 and a rear wall 23, which are substantially flat, which are parallel to and opposite one another, connected by curved side walls 24, each of which forms, for example, a semicylindrical surface. The cylindrical radius of the curved side walls 24 is substantially the same. A plurality of intended folded lines 36 is provided on the side walls 24 to enable correct folding thereof during formation of the packet 1.

The packet 1 thus has a rounded rectangular cross section.

The external enclosure 2 further comprises a secondary base wall 31 and a secondary top wall 11, connected to the main wall means, respectively to the front wall 22 and to the rear wall 23, at a base portion 6 and at a top portion 7 of said packet 1.

The side walls 24 form, in cooperation with the base wall 31 and with the top wall 11, respectively first openings 37 and second openings 17, for example, having a semicircular shape. The internal enclosure 2 includes a containing body 3, which can house the cigarettes, and a lid body 4 comprising a lid or cap that can be opened or closed to enable the user to access the contents of the packet. In particular, the lid 4 is movable between an open configuration A and a closed configuration C, rotating around a hinge 35 obtained on an external wall of the packet, in particular obtained on the rear wall 23 of the external enclosure 2, and substantially consisting of an intended folded line.

The containing body 3 comprises the base wall 31, from which a first front portion 22*a* of the front wall 22 and a first rear portion 23*a* of the rear wall 23 extend.

The first front portion 22*a* and the first rear portion 23*a* are connected by two first side portions 24*a* of the side walls 24.

The containing body 3 forms a box provided with an upper opening for inserting and removing cigarettes.

The lid 4 comprises the top wall 11 which, in the closed configuration C of the packet 1, is opposite the base wall 31. A second front portion 22*b* of the front wall 22 and a second rear portion 23*b* of the rear wall 23 are connected to the top wall 11. The second front portion 22*b* has, for example, a greater extent than the second rear portion 23*b*, which is separated from the first rear portion 23*a* by the hinge 35.

The second front portion 22*b* and the second rear portion 23*b* are connected by two second side portions 24*b* of the curved side walls 24.

Figure 4:
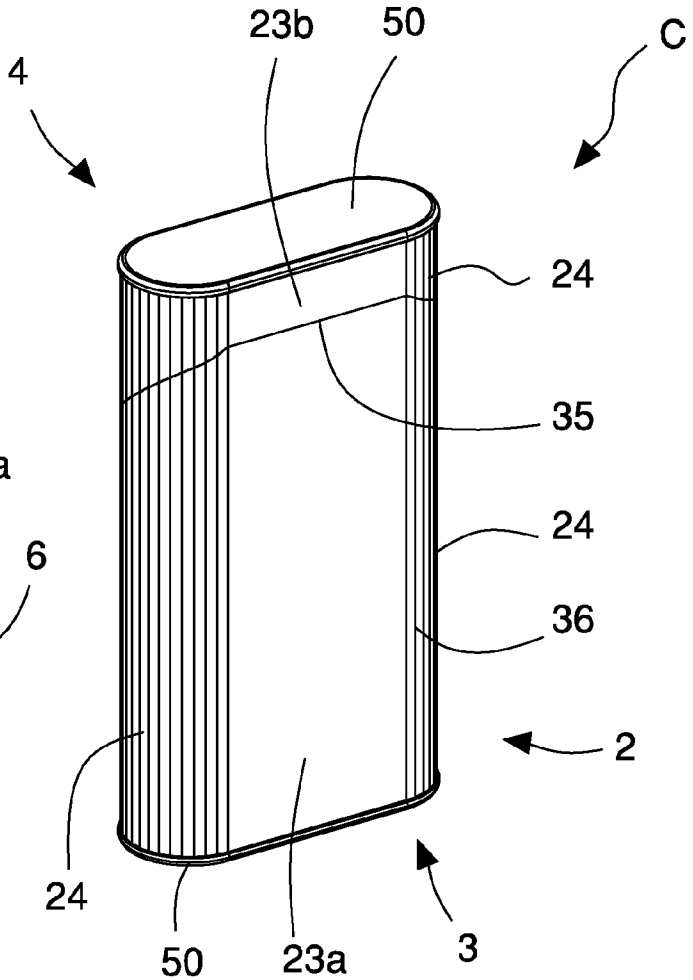
FIG. 4 is a rear perspective view of the packet in FIG. 1.
Figure 3:
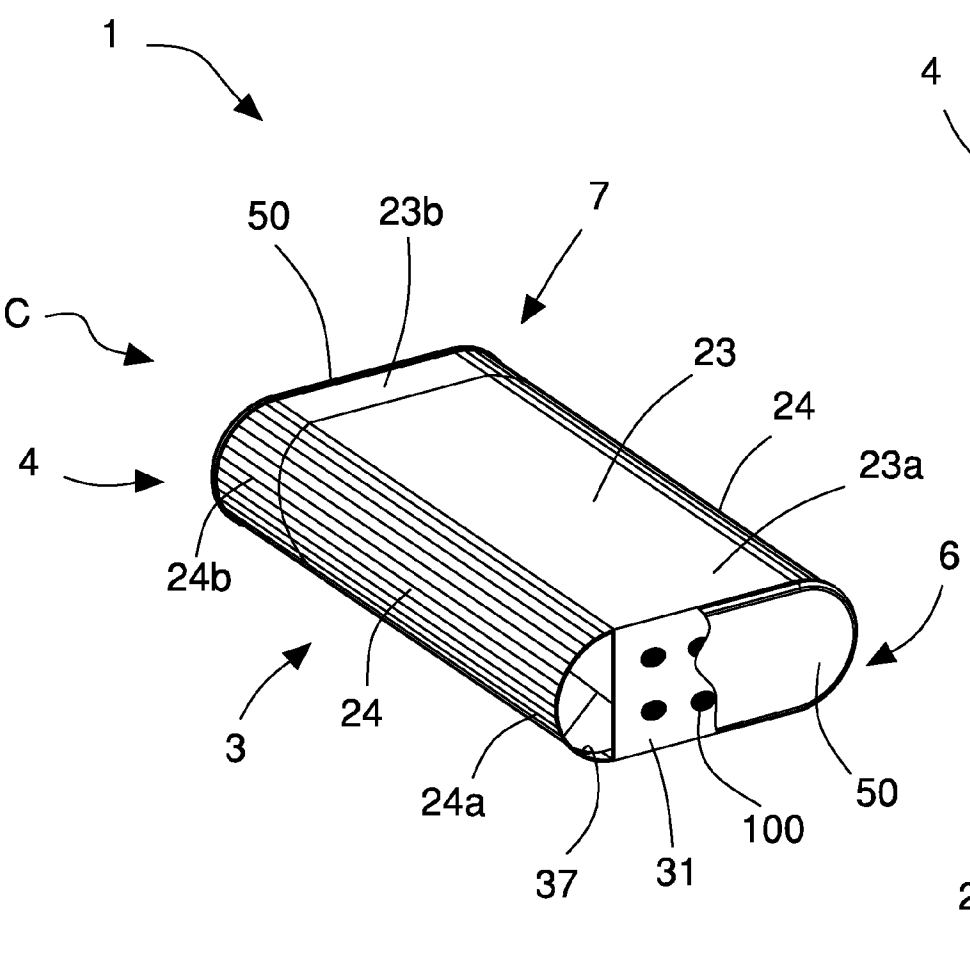
FIG. 3 is a rear bottom and partially sectioned perspective view of the packet in FIG. 1.
Figure 7:
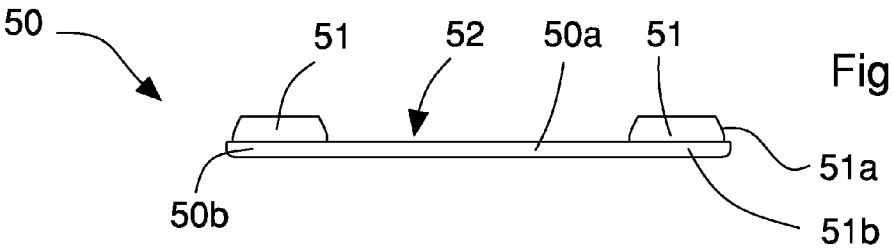
FIG. 7 is a front view of the closing element in FIG. 6.
Figure 6:
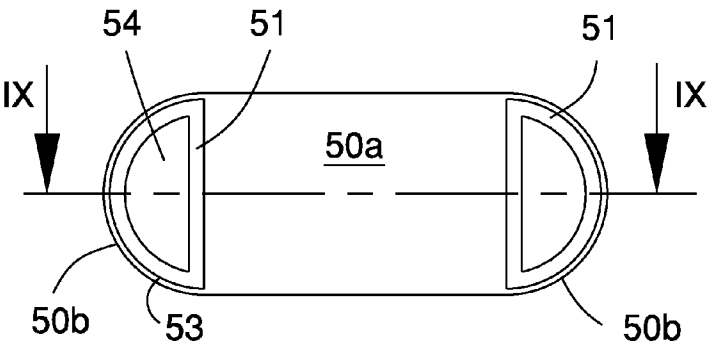
FIG. 6 is a top plan view of a closing element of the packet in FIG. 1.
Figure 8:
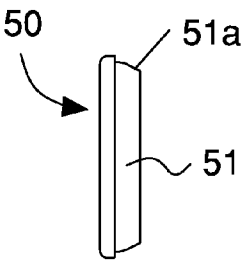
FIG. 8 is a side view of the closing element in FIG. 6.
Figure 9:
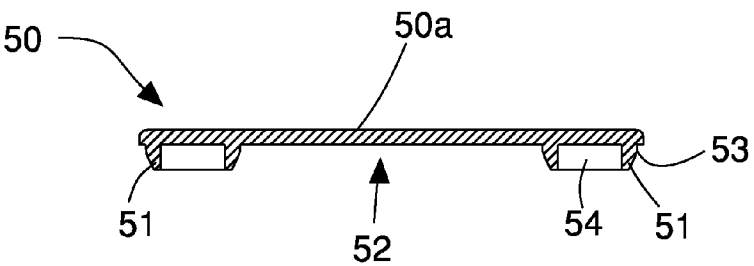
FIG. 9 is a section along the line IX-IX in FIG. 7.

When the packet 1 is in the closed configuration C shown in FIGS. 1, 3 and 4, the first front portion 22*a* and the first rear portion 23*a* of the containing body 3 are respectively contiguous with and substantially coplanar with, the second front portion 22*b* and the second rear portion 23*b* of the lid 4 such as to form the front wall 22 and the rear wall 23. Similarly the first side portions 24*a* are contiguous with and substantially aligned on the corresponding second side portions 24*b* to form the respective curved side walls 24.

The packet 1 further comprises closing elements 50 fixed to the base wall 31 and to the top wall 11 to close the base portion 6 and the top portion 7 of the packet 1 at the end of the packet 1 folding process.

With reference to FIGS. 6 to 12, each closing element 50 comprises a substantially flat body having a shape corresponding to the cross section of the packet 1, i.e. of the external enclosure 2. In particular the closing element 50 comprises a central portion 50*a* of rectangular shape, arranged for abutting on the base wall 31 or the top wall 11, and rounded end portions 50*b*, for example of semicircular shape, arranged for abutting on an end edge of the side walls 24.

On an internal face 52 of the closing element 50, at the end portions 50*b*, respective protrusions 51 are provided that are arranged for engaging in the openings 37, 17. The two protrusions 51 further form, with the central portion 50*a* of the closing element 50 a seat that is suitable for receiving the base wall 31 or the top wall 11.

Each protrusion 51 comprises, for example, a rib or elongated ridge having a portion with for example a semicircular shape that is complementary to the side wall 24. The protrusion 51 extends, for example, along a closed path that forms an internal cavity 54.

In an alternative embodiment that is not shown, the protrusion 51 is substantially full and has, for example, the shape of a circular sector.

The protrusion 51 forms with the internal face 52 of the closing element 50 an abutting edge 53 that is intended to engage a respective end edge of the side walls 24.

In this manner the closing elements 50 ensure a complete closure of the packet 1, avoiding a possible escape of product externally, typically tobacco detaching from cigarettes or cigars contained therein.

Figure 11:
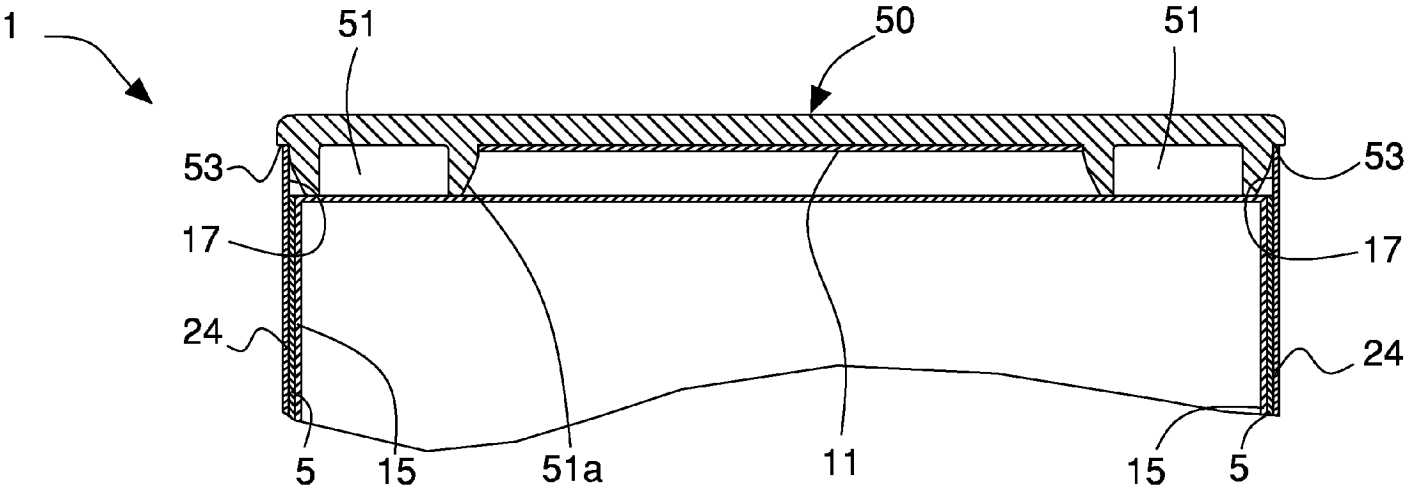
FIG. 11 is a frontal, partial, sectioned and enlarged view of the packet in FIG. 1.
Figure 12:
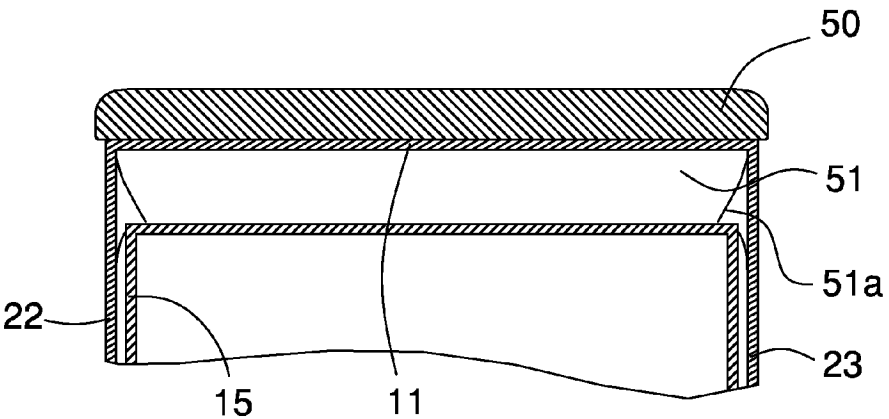
FIG. 12 is a lateral, partial, sectioned and enlarged view of the packet in FIG. 1.

With particular reference to FIG. 11, the protrusion 51 comprises an external wall 51*a* converging on the outside from the internal face 52 of the closing element 50, so as to enable said closing element 50 to be positioned more easily on the containing body 3 or on the lid 4.

The protrusions 51 further comprise a support and a guide for the side walls 24, so as to give the packet 1 a stable shape and a robust structure.

Each closing element 50 is fixed to the base wall 31 or to the top wall 11 by means of an adhesive substance 100, distributed by points or uniformly. In this manner, in addition to limiting the consumption of adhesive substance 100, the procedures for applying the adhesive substance are significantly simplified, which can be distributed over substantially flat surfaces.

The closing element 50 is made of stiff material, in particular of biodegradable plastics.

Figure 14:
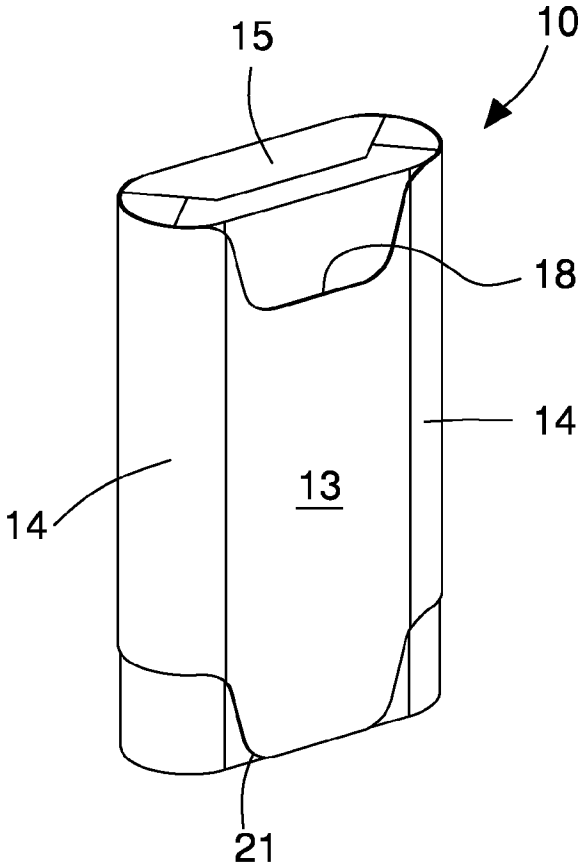
FIGS. 13 and 14 are respectively front and rear perspective views of an internal enclosure of the packet in FIG. 1.
Figure 13:
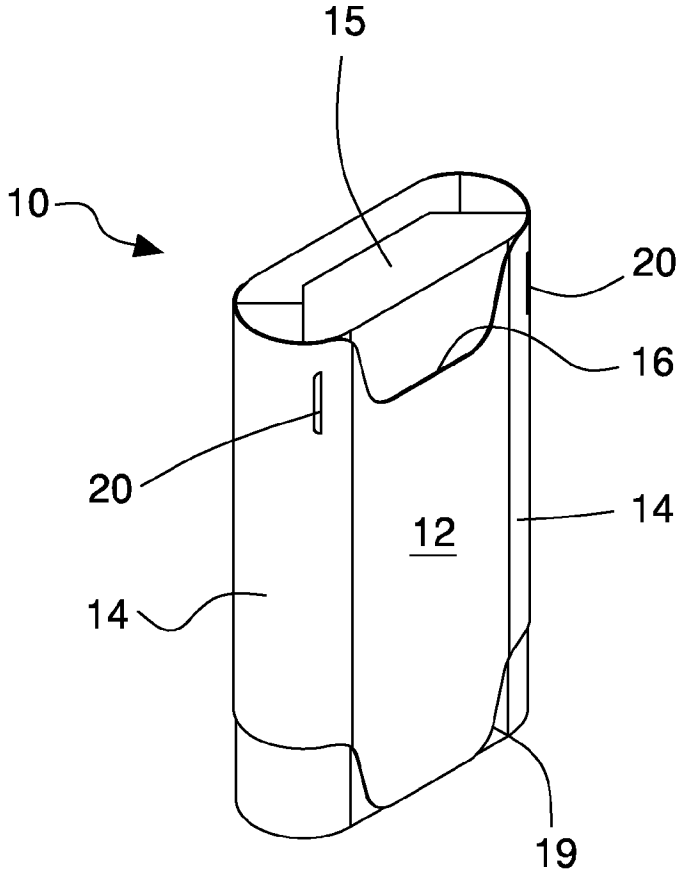

Inside the external enclosure 2 an internal enclosure 10 is positioned, shown in FIGS. 13 and 14, that houses an internal wrap 15, comprising a composition of cigarettes wrapped in a sheet of tinfoil or metallic foil. The internal wrap 15 is of known type and does not have substantially differences compared with the internal wraps used in normal cigarette packets.

The internal enclosure 10 further comprises an inner frame 5 of the type commonly used in packets of cigarettes for abutting on and guiding in closing the lid 4. The inner frame 5 is made of cardboard, possibly combined with a sheet of metal such as aluminium.

During packaging of the packet 1 the inner frame 5 is folded around the internal wrap 15, to which it can be made to adhere by means of points of adhesive substance.

The inner frame 5 can be folded around the internal wrap 15 by using a folding unit that is similar to what is used for traditional inner frames.

The internal enclosure 10 comprises a first wall 12 and a second wall 13 that are connected by two partially curved third walls 14. The latter have a shape and a curvature radius that is substantially the same as that of the side walls 24.

The first wall 12 and the second wall 13 are bounded by respective upper contours 16, 18 having a "U" shape and respective lower contours 19, 21, which are also "U"-shaped and complementary to the upper contours 16, 18.

On the third walls 14, near the upper contour 16 of the first wall 12, there protrude outwardly respective closing flaps 20, suitable for engaging with the lid 4 to maintain the latter in a closed configuration.

The internal enclosure 10 is arranged inside the external enclosure 2 and is glued to the latter.

In the closed configuration C of the packet 1 the internal enclosure 10 is abutted on below and above by the protrusions 51 of the respective closing elements 50.

Figure 15:
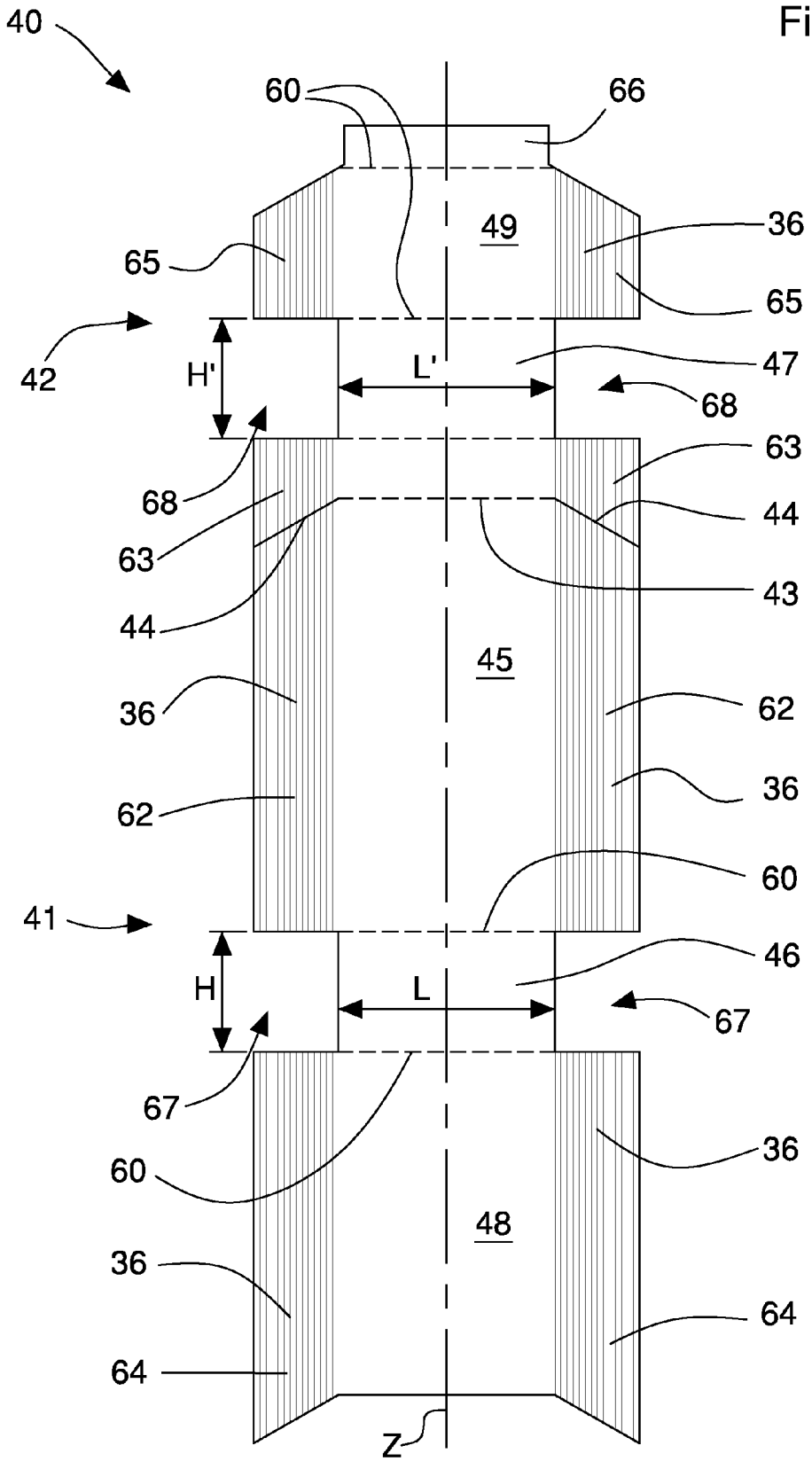
FIG. 15 is a plan view of a blank for obtaining an external enclosure of the packet in FIG. 1.

The external enclosure 2 is formed by folding a blank 40 of the type shown in FIG. 15, made, for example, of card or similar material.

The blank 40 comprises a first portion 41, intended for forming the containing body 3 of the external enclosure 2, and a second portion 42, intended for forming the lid body 4 of the external enclosure 2. The blank 40 extends along a respective longitudinal axis Z.

The first portion 41 and the second portion 42 are joined to one another along an intended transverse folded line 43 intended for giving rise to the hinge 35 in the packet 1.

The intended folded line 43 is transverse, in particular almost orthogonal, to the longitudinal axis Z and is obtained inside a first central panel 45 of the blank 40.

A first transverse panel 46 and a second transverse panel 47 are arranged at opposite ends of the first central panel 45, such that the first transverse panel 46, the first central panel 45 and the second transverse panel 47 are arranged in sequence along the longitudinal axis Z.

The first transverse panel 46 and the second transverse panel 47 have respectively a first transverse dimension or first width, L and a second transverse dimension or first width, L' that are less than a width B of the formed packet 1. The first transverse dimension L and the second transverse dimension L' are for example substantially equal.

The first transverse panel 46 and the second transverse panel 47 further have, respectively, a first longitudinal dimension, or first length, H, and a second longitudinal dimension, or second length, H' that are, for example, substantially the same as one another or at a depth or thickness D of the packet 1.

The transverse dimensions L, L' and the longitudinal dimensions H, H' are detected along directions that are respectively orthogonal and parallel to the longitudinal axis Z.

The blank 40 further comprises a pair of first side panels 62, arranged on the two sides of the first central panel 45 in a region defined between the intended folded line 43 and the first transverse panel 46. A pair of second side panels 63, is further provided, arranged on the two sides of the first central panel 45 in a region defined between the intended folded line 43 and the second transverse panel 47. Each first side panel 62 is separated from the corresponding second side panel 63 by means of a tilted cutting line 44. The tilted cutting lines 44 are arranged at the end of the intended folded line 43.

When the blank 40 is folded to form the packet 1, the first central panel 45 is intended for forming the rear wall 23 of the external enclosure 2, and in particular the first rear portion 23*a* of the containing body 3 and the second portion 23*b* of the lid body 4.

The first transverse panel 46 is intended for forming the secondary base wall 31 of the packet 1, whilst the second transverse panel 45 is intended for forming the secondary top wall 11 of the lid 4.

A second central panel 48 is connected to the first transverse panel 46, which second central panel 48 is intended for forming the first front portion 22*a* of the containing body 3.

Arranged on the two sides of the second central panel 48 a pair of third side panels 64 are provided that are intended to form, in association with the first side panels 62, the first side portions 24*a* of the side walls 24 in the containing body 3.

The third side panels 64 have a substantially rectangular trapezium shape with an oblique side protruding outwardly, and are symmetrical and opposite the longitudinal axis Z. The oblique sides are tilted like the cutting lines 44.

To the second transverse panel 47 there is connected a third central panel 49 that will form the second front portion 22*b* of the lid body 4.

A tab 66 is connected to the third central panel 49 on the opposite side to the second transverse panel 47, the tab 66 being arranged to be folded internally so as to reinforce the second front portion 22*b* of the lid body 4.

To opposite sides of the third central panel 49 a pair of fourth side panels 65 that have the shape of a rectangular trapezium and are complementary to the third side panels 64 are also connected so as to form, in association with the second side panels 63, the second side portions 24*b* of the side walls 24 in the lid body 4.

The second central panel 48, the first transverse panel 46, the first central panel 45, the second transverse panel 47, the third central panel 49 and the tab 66 are joined along respective creases 60, arranged transversely, in particular perpendicularly, to the longitudinal axis Z.

The first side panels 62, the third side panels 64 and the first transverse panel 46 define a pair of first recesses 67 on the blank 40.

Similarly, the second side panels 63, the fourth side panels 65 and the second transverse panel 47 define on the blank 40 a pair of second recesses 68.

The side panels 62, 63, 64, 65 and the transverse panels 46, 47 are devoid at the recesses 67, 68 of the blank 40 of appendages such as flaps or tabs or the like.

The recesses 67, 68 have a longitudinal extent that is, for example, the same as the longitudinal dimensions H, H' of the respective transverse panels 46, 47.

The recesses 67, 68 and the transverse dimensions L, L' of the transverse panels 46, 47, which are less than the respective width B of the packet 1, enable the side panels 62, 63, 64, 65, when folded, to form with the aforesaid transverse panels 46, 47 the openings 17, 37 that are suitable for receiving the protrusions 51 of the closing elements 50.

When the blank 40 is processed on a packaging machine, to the internal surface of the latter an adhesive substance is applied, for example, at peripheral portions of the first side panels 62 and of the second side panels 63 intended for being superimposed on corresponding peripheral portions of the third side panels 64 and of the fourth side panels 65. Alternatively or additionally, the adhesive substance can be applied to end portions of the side panels 62, 63, 64, 65 intended for abutting on the abutting edges 53 of the closing elements 50, to ensure a firmer closure of the packet 1.

After receiving the adhesive substance, the blank 40 is bent according to the traditional sequence of bending operations, as such this blank does not have additional panels with respect to traditional blanks. Thus, the blank 40 can be processed in a common machine for producing stiff packets of cigarettes.

In particular, when the blank 40 is folded to form the external enclosure 2, the first side panels 62 and the second side panels 63 are curved and partially superimposed on the third side panels 64 and on the fourth side panels 65 which are also curved, such as to form the curved side walls 24.

In order to facilitate folding and the curved conformation of the side walls 24 of the internal enclosure 2, the side panels 62, 63, 64, 65 are provided with a plurality of further intended longitudinal folded lines 36 that are parallel to one another and to the longitudinal axis Z.

During folding of the blank 40, the first central panel 45 and the second central panel 48 respectively form the rear wall 23 and the first front portion 22*a* of the containing body 3, that are opposite and parallel to one another. The third central panel 49 forms the second front portion 22*b* of the lid body 4, which is coplanar with the first frontal portion 22*a*.

If the inner frame 5 is folded around the internal wrap 15 of the cigarettes so as to form the internal enclosure 10, the external enclosure 2 of the packet 1 is constructed by folding the blank 40 around the aforesaid internal enclosure 10.

At the end of folding of the packet 1, the closing elements 50 are applied respectively to the base portion 6 and to the top portion 7 of the packet 1. In particular, a closing element 50 is fixed by adhesive substance 100 to the base wall 31, so that the central portion 50*a* thereof adheres thereto and at the same time the protrusions 51 are inserted inside the first openings 37, formed by the side walls 24 with the base wall 31.

Similarly, a closing element 50 is fixed by an adhesive substance 100 to the top wall 11, so that the central portion 50*a* thereof adheres thereto and the protrusions 51 are inserted inside the second openings 17 formed by the side walls 24 with the top wall 11.

The closing elements 50 can be applied in a dedicated operating station located downstream of the forming station of the packet 1.

From the foregoing remarks it is clear that the packet 1 can be made using packaging machines that do not substantially differ from the existing machines arranged for producing traditional packets.

In the figures shown, there has been represented only a packet provided with main walls comprising two substantially flat walls connected by two curved side walls, i.e. a packet having a cross section of rounded rectangular shape.

The packet according to the invention can nevertheless comprise one or more further curved or flat side walls and therefore have a cross section of polygonal, for example hexagonal or octagonal shape.

The packet can further comprise main walls including, in addition to the two flat walls, a single side wall and can thus have a triangular cross section.

The front wall 22 and the rear wall 23 can also be curved so as to form with the curved side walls 24 a packet having a cross section of elliptical or oval shape.

In all the aforesaid configurations, the closing elements 50, having a shape that is equivalent to the cross section of the packet, constitutes a support and a guide for the main walls of the external enclosure, such as to give the packet a stable shape and a robust structure.

The invention claimed is:

1. A packet for smoke articles comprising an outer enclosure including a containing body and a closing body that is rotatable around a hinge on an external wall of said packet, said packet including closing elements associated with main wall means of said outer enclosure for closing a base portion and a top portion of said packet, said outer enclosure comprising a base secondary wall and a top secondary wall connected to said main wall means and arranged for abutting on and supporting said closing elements, said main wall means comprising a front wall, an opposite rear wall, and side walls interposed between and connecting said front wall and said rear wall, wherein said side walls form in cooperation with said base secondary wall and said top secondary wall respectively first spaced-apart openings and second spaced-apart openings, wherein each closing element comprises spaced-apart protrusions on opposite end portions thereof, each protrusion extending into one of the first openings and the second openings, and wherein each closing element is fixed to one of the base secondary wall and the top secondary wall by an adhesive substance.

2. The packet according to claim 1, wherein said base secondary wall and said top secondary wall are opposite and transverse to one another, and substantially orthogonal to said main wall means in a closed configuration of said packet.

3. The packet according to claim 1, wherein said external wall is said rear wall.

4. The packet according to claim 1, wherein said rear wall is substantially flat.

5. The packet according to claim 1, wherein said side walls are curved.

6. The packet according to claim 1, wherein each closing element comprises at each protrusion an abutting edge arranged for engaging a respective end edge of said side walls.

7. The packet according to claim 1, wherein said closing elements are made of biodegradable plastics.

8. A combination of a blank and two closing elements for producing a packet for smoke articles, said blank comprising a first portion for forming a containing body of said packet and connected along an intended folding line to a second portion for forming a closing body of said packet; a first central panel for forming a rear wall of said packet; a first transverse panel and a second transverse panel arranged at opposite ends of said first central panel for forming a base wall and a top wall respectively of said packet; a second central panel and a third central panel connected to said first transverse panel and to said second transverse panel respectively for forming a front wall of said packet; side panels arranged on sides of said central panels for forming side walls of said packet, said side panels and said transverse panels forming on said blank respective recesses at which said side panels and said transverse panels are devoid of foldable appendages, wherein said first transverse panel and said second transverse panel have respective transverse dimensions that are less than a width of said packet, wherein said two closing elements each include spaced-apart protrusions on opposite end portions thereof, each protrusion engaging one of first spaced-apart openings and second spaced-apart openings formed in the containing body, and wherein each closing element is fixed to one of the base wall and the top wall by an adhesive substance.

9. The combination according to claim 8, wherein said side panels are provided with a plurality of further longitudinal intended folding lines so as to form curved side walls.

* * * * *